United States Patent [19]

Shibanov et al.

[11] 4,450,888

[45] May 29, 1984

[54] MOULDING PLANT

[75] Inventors: Dmitry A. Shibanov; Inokenty A. Onufriev; Vladimir A. Khristov; Evgeny A. Sergeev, all of Moscow, U.S.S.R.

[73] Assignee: NPO "Viilitmash", Moscow, U.S.S.R.

[21] Appl. No.: 308,539

[22] PCT Filed: Feb. 1, 1980

[86] PCT No.: PCT/SU80/00018

§ 371 Date: Sep. 28, 1981

§ 102(e) Date: Sep. 28, 1981

[87] PCT Pub. No.: WO81/02122

PCT Pub. Date: Aug. 6, 1981

[51] Int. Cl.[3] ..... B22C 15/06; B22C 15/20

[52] U.S. Cl. ..... 164/183; 164/192; 164/198

[58] Field of Search ..... 164/183, 184, 185, 192, 164/200, 201, 205, 209, 198

[56] References Cited

U.S. PATENT DOCUMENTS 3,939,899 2/1976 Kawai ..... 164/181

FOREIGN PATENT DOCUMENTS 216762 12/1909 Fed. Rep. of Germany .
49-27486 7/1974 Japan .
2069900 2/1981 United Kingdom ..... 164/198
501827 5/1976 U.S.S.R. .

OTHER PUBLICATIONS

"Moulding Plants," NIIMASH Publishers, Moscow, No. 12, 1970, pp. 79–82.

*Primary Examiner*—Kuang Y. Lin
*Assistant Examiner*—J. Reed Batten, Jr.
*Attorney, Agent, or Firm*—McAulay, Fields, Fisher, Goldstein & Nissen

[57] ABSTRACT

A moulding plant comprises a sandslinger 2 and a turnover and withdrawal mechanism mounted on a common bed. The turnover mechanism is made in the form of two disks spaced apart and coupled to a drive designed to turn the turnover and withdrawal apparatus in a vertical plane relative to their horizontal axes. Rigidly fixed between the disks are side-roller conveyers wherebetween is mounted a double-sided pattern plate with top and bottom patterns. The withdrawal mechanism comprises power cylinders for moving the pattern plate with the top and bottom patterns. Mounted on the bed are two side-roller conveyers designed for carrying empty moulding boxes to the turnover and withdrawal mechanism.

12 Claims, 3 Drawing Figures

MOULDING PLANT

FIELD OF THE INVENTION

The invention relates to foundry practice and has particular reference to moulding plants.

BACKGROUND ART

There is known in the art a moulding plant which comprises a moulding machine and a turnover and withdrawal apparatus which includes a bed, a turnover device, a gripping device for holding moulding boxes during turnover, and a pattern withdrawal table. This plant produces moulds formed with intricate-shaped patterns.

The moulding process of said plant involves alternate use of two patterns: one for top half-moulds or copes and the other for bottom half-moulds or drags. Cope and drag moulding boxes are delivered to the plant in the appropriate sequence. As the moulding table rises during operation, it receives first a pattern and then a moulding box, the latter being seated over the pattern. The moulding box is filled with sand which is compacted by jolting. During the jolting operation the press plate is delivered into the working position. On the upstroke of the squeezer piston incorporated in the moulding table the upper layers of the sand in the moulding box are forced against the squeeze board, whereby the sand is compressed. The latest modernized machines are capable of performing sand compression simultaneously with or subsequent to jolting. After the sand packing is accomplished, the pattern complete with the half-mould in the moulding box is placed onto rollers and the jolting table is lowered. The pattern with the half-mould is transported into the turnover and withdrawal apparatus, which is made in two sections. The pattern with the half-mould is gripped in the turnover device and turned through 180° so that the pattern is on the top. The withdrawal table arrives underneath the half-mould. The grips holding the half-mould to the pattern plate release and the half-mould lowers together with the withdrawal table, leaving the pattern in the turnover device and thereby accomplishing its withdrawal. The pattern is returned into the initial position by rotation of the turnover device and then is carried by a grip onto the jolting table.

The moulding plant under consideration is disadvantageous in that the working capacity thereof is low because the pattern outfit has to make many opposing strokes. A further disadvantage is that the plant includes a large number of actuating mechanisms and occupies large floor space.

Also known in the art is a moulding plant (see catalog "Moulding Plants", No 12, published in 1970, NIIMASH Publishers, Moscow, pp. 79–82) comprising a movable sandslinger and a turnover and withdrawal apparatus having a turnover mechanism and a pattern withdrawal mechanism. The turnover mechanism is made in the form of two disks spaced apart and mounted on rollers. The disks are connected with a drive designed to turn the turnover and withdrawal apparatus in a vertical plane about the horizontal axis of the disks. Located between the disks in symmetry with their horizontal axis and parallel thereto are two roller conveyor sections which are mounted on crossmembers installed between the disks. The pattern withdrawal mechanism comprises power cylinders disposed on the crossmembers between the turnover mechanism disks for the purpose of withdrawing patterns together with a pattern plate.

The sandslinger is arranged to move on the principle of an overhead travelling crane.

The sandslinger and the turnover and withdrawal apparatus are located separately one after the other.

The prior-art moulding plant operates as follows.

A moulding box is placed on a pattern plate by means of a crane or another hoisting device. Then the pattern complete with the moulding box is delivered underneath the sandslinger by means of live rollers. To enable the sandslinger to feed sand at any point of the mould being formed, it is arranged to travel in the manner of an overhead crane. To this end, use is made of two trolleys. One trolley mounts the sandslinger and moves across the moulding box, the other trolley moves along the moulding box. After the half-mould is made, it is delivered together with the pattern into the turnover and withdrawal apparatus by the use of the lower section of dead rollers. Prior to turning over, the withdrawal mechanism fixes the moulding box to the pattern plate. Then, a turn through 180° is made, whereby the pattern plate is placed at the top, whereas the moulding box with the half-mould is located underneath on the withdrawal mechanism. As the withdrawal mechanism is lowered, the pattern plate comes onto stops and rests in place, whereby the pattern is withdrawn from the moulding box. In the lowermost position the moulding box rests on rollers and the withdrawal table goes further down. The formed half-mould, with the cavity at the top, is ejected from the turnover mechanism onto the live rollers and is transported to the place of assembly. The pattern is turned through 180° and thus returned into the initial position, whereupon it is transported to the sandslinger by the use of the dead rollers provided in the turnover mechanism. A moulding box is installed on the pattern plate and the cycle is resumed.

The moulding plant described above suffers from the disadvantage that its working capacity is insufficient due to a substantially large numer of transport operations necessitated by moving the pattern from the sandslinger to the turnover and withdrawal apparatus and in reverse. Furthermore, the plant requires large floor space, since the sandslinger and the turnover and withdrawal apparatus are located separately and connected by means of roller conveyors.

DISCLOSURE OF THE INVENTION

It is an object of the present invention to provide a moulding plant of high working capacity by employing a widespread sandslinger and a turnover and withdrawal apparatus capable of performing a number of operations simultaneously.

The invention provides a moulding plant comprising a sandslinger and a turnover and withdrawal apparatus having a turnover mechanism and a pattern withdrawal mechanism, the turnover mechanism being made in the form of two disks spaced apart and coaxially mounted on rollers, the disks being connected with a drive designed to turn the turnover and withdrawal apparatus in a vertical plane about the horizontal axis of the disks; located between the disks in symmetry with their horizontal axis and parallel thereto are two roller conveyors which are mounted on crossmembers installed between the disks, the pattern withdrawal mechanism including power cylinders mounted on the crossmembers between the turnover mechanism disks for the purpose of withdrawing patterns together with a pattern plate, wherein the sandslinger is located over the turnover and withdrawal apparatus with the possibility for horizontal reciprocating movement; installed in the turnover and withdrawal apparatus is a double-sided pattern plate both sides of which are designed for attachment of patterns for cope and drag moulding boxes which are carried by top and bottom roller conveyers respectively, the double-sided pattern plate being adapted to be rotated together with the turnover and withdrawal apparatus and to be moved vertically between the cope and drag moulding boxes in order to withdraw the pattern from the completed half-mould in one of the moulding boxes simultaneously with assembling the other moulding box with the respective pattern.

The moulding plant of the present invention permits production output to be increased without expanding the floor space under the process equipment and also makes for widening the scope of mechanized casting.

The invention will now be described, by way of example, with reference to the accompanying drawings, wherein.

BEST MODE OF CARRYING OUT THE INVENTION

Figure 1:
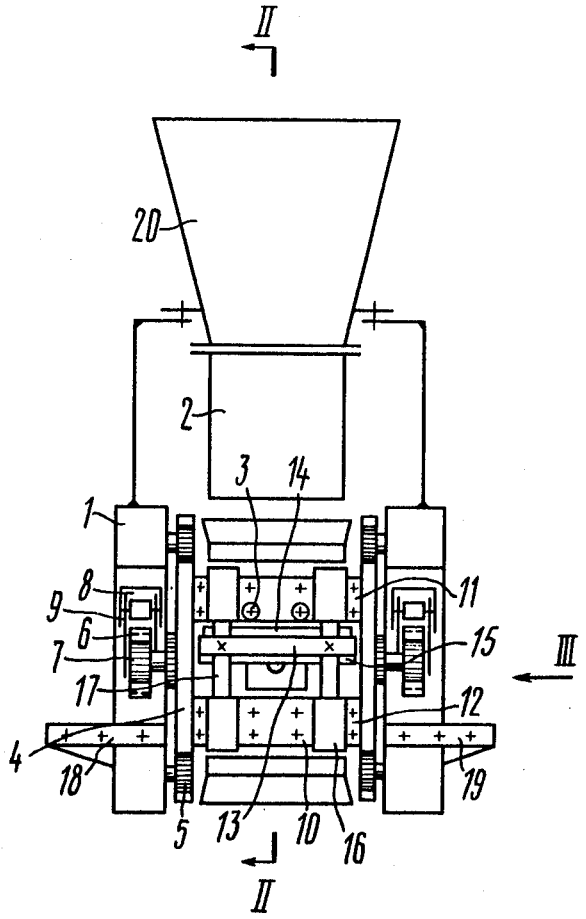
FIG. 1 is a general view of the moulding plant according to the invention.

The moulding plant illustrated comprises a bed 1 (FIG. 1) and a wide-spread sandslinger 2 mounted thereabove for horizontal reciprocating movement. Mounted inside the bed 1 is a turnover and withdrawal apparatus 3 which includes a turnover mechanism and a pattern withdrawal mechanism.

The turnover mechanism is made in the form of two disks 4 spaced apart and coaxially mounted on rollers 5. The disks 4 are provided with a drive designed to turn the turnover and withdrawal apparatus 3 in a vertical plane about the axis of said disks. The drive consists of a pair of gears 6 and 7 and a swivelling pneumatic cylinder 8 connected thereto by means of a lever 9. Fixedly mounted on crossmembers 10 between the disks 4 in symmetry with their horizontal axis and parallel thereto are upper and lower side-roller conveyors 11 and 12 respectively, the rollers thereof being arranged in two rows.

Installed in the turnover and withdrawal apparatus 3 between the upper roller conveyor 11 and the lower roller conveyer 12 is a vertically movable double-sided pattern plate 13 whose top and bottom sides are designed for attachment of a top pattern 14 and a bottom pattern 15.

The pattern withdrawal mechanism 3 comprises opposed plunger-type power cylinders 16 designed for moving the pattern plate 13 together with the patterns 14 and 15 attached thereto. The power cylinders 16 are made integral with the crossmembers 10 and their plungers 17 are rigidly connected to the pattern plate 13.

The bed 1 mounts two side-roller conveyors 18 and 19 designed for carrying empty moulding boxes into the turnover and withdrawal apparatus through a window in one of the disks 4 and for delivering therefrom through a window in the other of the disks 4 moulding boxes with completed half-moulds.

Located over the sandslinger 2 is a feeder 20 comprising a slide gate 21 (FIG. 2) connected to an air-operated actuator 22. A belt conveyor 23 for feeding moulding sand is installed above the feeder 20. The sandslinger 2 is caused to travel by a pneumatic cylinder 24.

Figure 3:
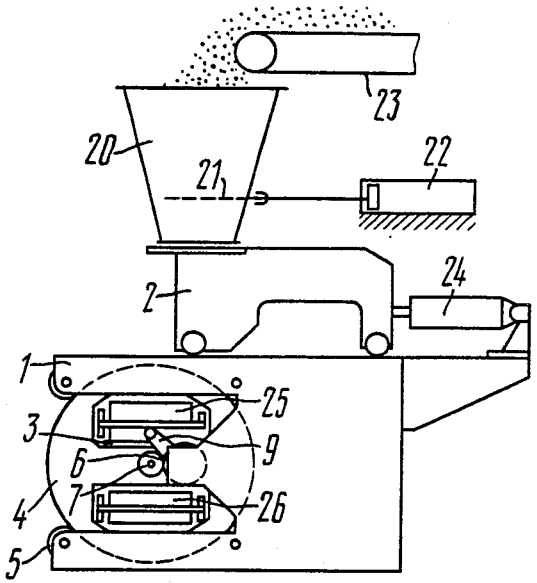
FIG. 3 is a sectional view on the line III—III of FIG. 1, according to the invention.

FIG. 3 depicts the cope moulding box 25 in position for filling with sand and the drag moulding box 26 is shown during delivery thereof into the turnover and withdrawal apparatus 3 by means of the roller conveyor 19 (FIG. 1).

The moulding plant operates as follows.

When the moulding plant is put in operation, the power cylinders 16 (FIG. 1) raise the pattern plate 13 together with the patterns 14 and 15 attached thereto, whereby, in one stroke of the power cylinders 16, the bottom pattern 15 is withdrawn from the completed half-mould in the drag moulding box 26 (FIG. 3), whilst the empty cope moulding box 25 is assembled with the top pattern 14 (FIG. 1).

Figure 2:
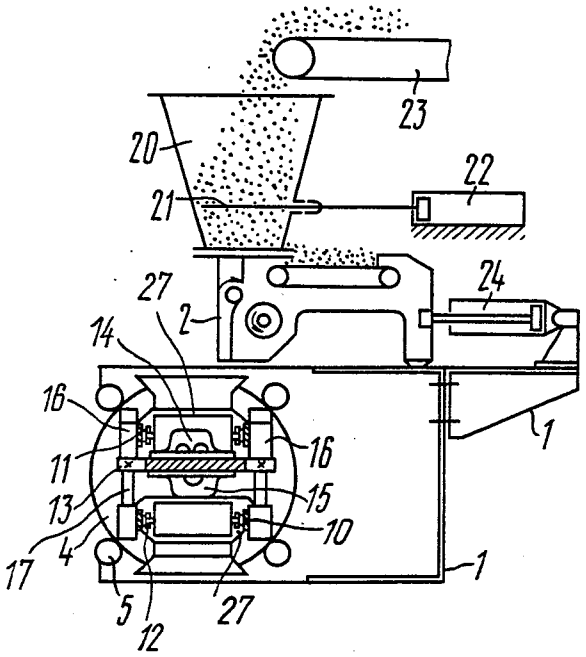
FIG. 2 is a sectional view on the line II—II of FIG. 1, according to the invention.

At the same time, a charge of moulding sand is metered in the feeder 20 (FIG. 2). To this end, the slide gate 21 is opened by means of the pneumatic actuator 22, a portion of sand is discharged down the feeder 20 whereupon the slide gate 21 is closed.

In the course of its reciprocating motion the sandslinger 2 fills the top moulding box 25 (FIG. 3) with sand.

The drag moulding box 26 containing a completed half-mould is ejected by a pneumatic cylinder (not shown) from the turnover and withdrawal apparatus 3 and is replaced with an empty moulding box. The movement of the moulding boxes 25 and 26 is effected by means of the side-roller conveyors 11 and 12 (FIG. 1) installed inside the turnover and withdrawal apparatus 3 and by means of the roller conveyors 18 and 19 mounted on the bed 1.

After the cope moulding box 25 (FIG. 3) is filled up and the drag moulding box 26 containing a completed half-mould is replaced with an empty moulding box, the turnover and withdrawal apparatus 3 is turned through 180° and thereafter the cycle is repeated.

The turning movement of the turnover and withdrawal apparatus 3 is actuated by the swivelling pneumatic cylinder 8. For this purpose the lever 9 articulated to the gear 6 is turned by the cylinder 8 through 90°. Inasmuch as the ratio between the gears 6 and 7 is 1 to 2, turning the gear 6 through 90° causes the gear 7 to turn through 180° together with the turnover and withdrawal apparatus 3.

In each cycle the turnover and withdrawal apparatus 3 makes a to-and-fro rotary movement in a vertical plane.

The moulding plant of the present invention can be used in a production line for both small-lot and mass manufacture of intricate-shaped moulds.

Since the sandslinger 2 and the turnover and withdrawal apparatus 3 are united by the common bed 1 to form a whole mechanism, the size of the moulding plant is substantially small and, accordingly, it requires small floor space in a production line.

The moulding plant is free from dynamic loads and does not require costly foundations, especially for second-floor mounting.

The mould production time is saved and the working capacity of the moulding plant is increased since the patterns 14 and 15 are not transferred from the sandslinger 2 to the turnover and withdrawal apparatus 3 and backwards.

The number of the mechanisms used for moving the pattern plate 13 is substantially small, which makes for increased dependability and economies in maintenance and repair costs.

The moulding plant produces little noise, thus promoting health conditions in the working area.

Commercial Applicability

The moulding plant of the present invention can be used to advantage in transfer moulding lines.

We claim:

1. A moulding plant comprising:

a sandslinger;

a turnover and withdrawal apparatus having a turnover mechanism and a pattern withdrawal mechanism, said turnover mechanism being made in the form of two disks spaced apart and coaxially mounted on rollers, which disks are connected with a drive designed to turn the turnover and withdrawal apparatus in a vertical plane about the horizontal axis of the disks, two roller conveyors mounted on crossmembers installed between the disks being located between said disks in symmetry with their horizontal axis and parallel thereto, said pattern withdrawal mechanism incorporated power cylinders disposed on the crossmembers between the turnover mechanism disks for the purpose of withdrawing patterns together with a pattern plate, wherein the sandslinger is located over the turnover and withdrawal apparatus with the possibility for horizontal reciprocating movement, the turnover and withdrawal apparatus being provided with a double-sided pattern plate both sides of which are designed for attachment of patterns for cope and drag moulding boxes carried by top and bottom roller conveyers respectively, said double-sided pattern plate being mounted for rotation together with the turnover and withdrawal apparatus and for vertical movement between the cope and drag moulding boxes in order to withdraw the pattern from the completed half-mould in one of the moulding boxes simultaneously with assembling the other moulding box with the respective pattern.

2. A moulding plant comprising:

a rotatable turnover and withdrawal apparatus including a turnover mechanism and a pattern withdrawal mechanism formed of two spaced apart disks coaxially mounted on rollers, said turnover and withdrawal apparatus being provided with a double-sided pattern plate mounted for rotation with said turnover and withdrawal apparatus, both sides of said pattern plate being adapted for attachment of patterns for cope and drag moulding boxes, said double-sided pattern plate being mounted for movement vertically between said cope and drag moulding boxes;

a sandslinger mounted above said turnover and withdrawal apparatus for horizontal reciprocating movements;

a drive connected with said disks for turning said turnover and withdrawal apparatus in a vertical plane about the horizontal axis of said disks for movement of said double-sided pattern plate vertically between said cope and drag moulding boxes;

a pair of upper roller conveyors and a pair of lower roller conveyors for carrying said cope and drag moulding boxes, each of said pair of roller conveyors being mounted on a cross member positioned between said disks in symmetry with the horizontal axis thereof and parellel thereto; and said pattern withdrawal mechanism including power cylinders disposed on the cross members between said disks for withdrawing the patterns together with the pattern plate.

3. The moulding plant of claim 2, including a common bed, said turnover and withdrawal apparatus being mounted inside said bed, and said sandslinger being mounted on said common bed above said turnover and withdrawal apparatus.

4. The moulding plant of claim 2 wherein said withdrawal mechanism, includes opposed plunger-type cylinders for moving said pattern plate.

5. The moulding plant of claim 2, including a power cylinder operatively associated with said pattern plate for withdrawing the bottom pattern from a completed half-mould in said drag moulding box while assembling an empty cope moulding box with the top pattern in a single stroke of said power cylinder.

6. The moulding plant of claim 2, including a pneumatic actuator coupled to said sandslinger for metering moulding therefrom into said empty cope moulding box simultaneously with the assembling of the top pattern with said empty cope moulding box.

7. The moulding plant of claim 2, wherein said turnover and withdrawal mechanism makes a to-and-fro rotary movement in the vertical plane.

8. The moulding plant of claim 7, wherein one of said gears together with said turnover and withdrawal apparatus turns through 180°.

9. The moulding plant of claim 2, wherein said drive includes a pair of gears, a swivelling pneumatic cylinder and a lever connecting said cylinder and said gears.

10. A moulding plant comprising:

a sandslinger;

a turnover and withdrawal apparatus having a turnover mechanism and a pattern withdrawal mechanism, said turnover mechanism being formed from two disks spaced apart and coaxially mounted on rollers, said disks being connected with a drive for turning said turnover and withdrawal apparatus in a vertical plane about the horizontal axis of said disks;

two roller conveyors located between said disks in symmetry with their horizontal axis and parallel thereto and mounted on cross-members installed between said disks;

said pattern withdrawal mechanism including power cylinders mounted on said cross-members between said turnover mechanism disks for withdrawing patterns together with a pattern plate;

said sandslinger being located over said turnover and withdrawal apparatus and capable of horizontal reciprocating movement; and a double-sided pattern plate installed in said turnover and withdrawal apparatus both sides of said pattern plate being designed for attachment of patterns for cope and drag moulding boxes which are carried by top and bottom roller conveyors respectively, said double-sided pattern plate being adapted for rotation together with said turnover and withdrawal apparatus and for movement vertically between said cope and drag moulding boxes for withdrawing the pattern from the completed half-mould in one of the moulding boxes simultaneously with assembling the other moulding box with the respective pattern.

11. The moulding plant of claim 10, including a common bed, said turnover and withdrawal apparatus being mounted inside said bed, and said sandslinger being mounted on said common bed above said turnover and withdrawal apparatus.

12. The moulding plant of claim 10, wherein the moulds are turned over inside said common bed by said turnover and withdrawal apparatus.

* * * * *